US006880366B2

(12) United States Patent
Mayer et al.

(10) Patent No.: US 6,880,366 B2
(45) Date of Patent: Apr. 19, 2005

(54) TEXTILE MACHINE WITH AT LEAST ONE DUST REMOVAL DEVICE

(75) Inventors: Marcus Mayer, Messstetten (DE); Waldemar Pschellok, Albstadt (DE)

(73) Assignee: SIPRA Patententwicklungs- und Beteiligungsgesellschaft mbH, Albstadt (DE)

( * ) Notice: Subject to any disclaimer, the term of this patent is extended or adjusted under 35 U.S.C. 154(b) by 18 days.

(21) Appl. No.: 10/718,377

(22) Filed: Nov. 20, 2003

(65) Prior Publication Data

US 2004/0099018 A1 May 27, 2004

(30) Foreign Application Priority Data

Nov. 25, 2002 (DE) ..... 102 55 382

(51) Int. Cl.[7] ..... D04B 7/00
(52) U.S. Cl. ..... 66/168
(58) Field of Search ..... 66/168, 8; 15/1.51

(56) References Cited

U.S. PATENT DOCUMENTS

| | | | | |
|---|---|---|---|---|
| 2,151,273 A | * | 3/1939 | Hess | 15/1.51 |
| 3,422,640 A | | 1/1969 | Abrams | |
| 3,678,713 A | * | 7/1972 | Woodford | 66/132 R |
| 5,737,942 A | * | 4/1998 | Gutschmit | 66/168 |
| 6,285,032 B1 | * | 9/2001 | Hahne et al. | 250/492.3 |

FOREIGN PATENT DOCUMENTS

| | | |
|---|---|---|
| DE | 128 495 A | 11/1977 |
| DE | 79 26 865 | 12/1980 |
| DE | 32 19 467 A1 | 7/1983 |
| DE | 36 28 851 A1 | 3/1987 |
| DE | 41 20 973 A1 | 1/1993 |
| DE | 195 25 453 A1 | 1/1997 |
| DE | 197 11 342 A1 | 9/1998 |
| DE | 100 18 010 A1 | 10/2001 |
| EP | 0 816 546 A2 | 1/1998 |
| EP | 0 531 019 B1 | 11/2000 |
| EP | 1 053 196 B1 | 8/2002 |
| WO | 91/12095 | 8/1991 |
| WO | 95/09259 | 4/1995 |
| WO | 01/18295 A1 | 3/2001 |

* cited by examiner

*Primary Examiner*—Danny Worrell
(74) *Attorney, Agent, or Firm*—Michael J. Striker

(57) ABSTRACT

A textile machine with at least one dust removal device is described. The dust removal is performed by providing at least one electrostatically chargeable dust collector element (16) and a means (24, 25) for removing dust collected with the dust collector element (16) (FIG. 2).

12 Claims, 3 Drawing Sheets

TEXTILE MACHINE WITH AT LEAST ONE DUST REMOVAL DEVICE

FIELD OF THE INVENTION

The invention relates to a textile machine, in particular a knitting machine, equipped with at least one dust removal device.

BACKGROUND OF THE INVENTION

The term "dust removal" in the technical field of textile machines and in the scope of the present invention should be understood to mean measures for the purpose of collecting and/or removing dusts that are formed during textile production or textile processing and are dispersed in the air, e.g. by fly lint, and for the prevention of harmful accumulations of dust forming at sensitive function points of the textile machine. In this case, the term "dust" not only covers dusts in the form of fibres and lint particles or fluff, but fundamentally all particles which are formed in textile technology and pass into the atmosphere.

Permanent sources of dusts of this type in the case of weaving and knitting machines are in particular unavoidable feed, braking and monitoring systems for threads of all types as well as devices for their guidance, deflection and control such as thread eyes or guide bars. Since most yarn qualities, but above all cotton threads, cause substantial fluff formation, the pieces of fluff are easily deposited on other machine elements, where they form tufts or clumps that gradually increase in size and as a result can impair the function of the respective textile machine. Therefore, it is generally known to equip textile machines of a wide variety of types with dust removal devices in order to remove, where possible, any dusts produced before they are deposited.

The dust removal devices known hitherto in textile machines largely operate with blower and/or suction devices (e.g. DE 79 26 685 U1, DE 32 19 467 A1, U.S. Pat. No. 3,422,640, EP 0 531 019 B1). Some of these have complex air distributor arrangements to enable blower and/or suction nozzles to be disposed at as many locations of the respective textile machine as possible. Dust removal devices integrated into thread feed devices are also known in this context (e.g. EP 1 053 196 B1, WO 01/18295), and also dust removal devices primarily for the purpose of keeping those regions of a circular knitting machine dust-free where textile threads are worked by knitting tools to form stitches (e.g. WO 95/09259, EP 0816 546 A2).

Therefore, dust removal devices of this type are technically complex and associated with a high energy consumption for the generation of compressed air and/or suction air. Blower and/or suction nozzles, moreover, frequently render access to the function points difficult, and this makes repairs and maintenance difficult.

In addition, devices are known for the purpose of removing dusts accumulating on moving webs of material, e.g. paper, textile or plastic webs, by electrostatically charging and/or discharging the material webs by using electrodes before the webs are fed into an suction station (e.g. WO 91/12095, DE 41 20 973 A1, DE 100 18 010 A1, DE 195 25 453 A1, DE 197 11 342 A1). This takes into consideration the physical phenomenon that both electrically non-conductive material webs and dust particles dispersed in the air are frequently electrostatically charged by contact and/or frictional electricity and particularly strong adhesion forces occur in the case of opposed polarities. The treatment of material webs with charge and/or discharge electrodes should therefore electrostatically neutralise dusts adhering to them and as a result reduce the electrostatic adhesion forces. However, such devices only allow the disposal of dusts, which are already deposited on a material web, e.g. a finished woven or knitted textile. Problems caused in textile machines in particular by dust and fly lint cannot be resolved with such devices.

OBJECTS OF THE INVENTION

Starting from this prior art, it is an object of the present invention to provide a dust removal device for textile machines, in particular knitting machines, which does not require complicated air guide means.

A further object of the present invention is to design a textile machine, particularly a knitting machine, of the kind specified above and being less complex in design than textile machines with known dust removal devices.

Yet another object of the present invention is to provide a textile machine, particularly a knitting machine, with a dust removal device which is less complex in design than known dust removal devices and which manages with blowers of comparatively small dimensions for blowing and/or suction purposes.

SUMMARY OF THE INVENTION

To solve this problem, the invention proposes a dust removal device, which contains at least one electrostatically chargeable dust collector element and a means for removing dust collected with the dust collector element.

The invention is based on the concept of attracting electrically charged dust particles by means of an electrostatically charged collector element and then removing the accumulated dust from the collector element. In a particularly preferred embodiment of the invention, a moving belt is used for this purpose. This belt is electrically charged at a charge station so that it picks up dust from the surrounding atmosphere, or attracts this dust as a result of electrical attraction forces, during its transport along a predetermined path. Moreover, the belt is electrically neutralised at a discharge station disposed behind the charge station in the direction of movement, in order to loosen dust collected on it and enable easy removal of the dust by means of a suction device, for example. The dust collector element according to the invention can therefore replace a plurality of previously necessary suction and/or blower nozzles, so that, in principle, only a single central extractor device is required for removal of the collected dust.

Further advantageous features of the invention may be seen from the sub-claims.

BRIEF DESCRIPTION OF THE DRAWINGS

The invention shall be explained in more detail below in association with the attached drawings by way of the practical example of a circular knitting machine.

DETAILED DESCRIPTION OF THE DRAWINGS

Figure 1:
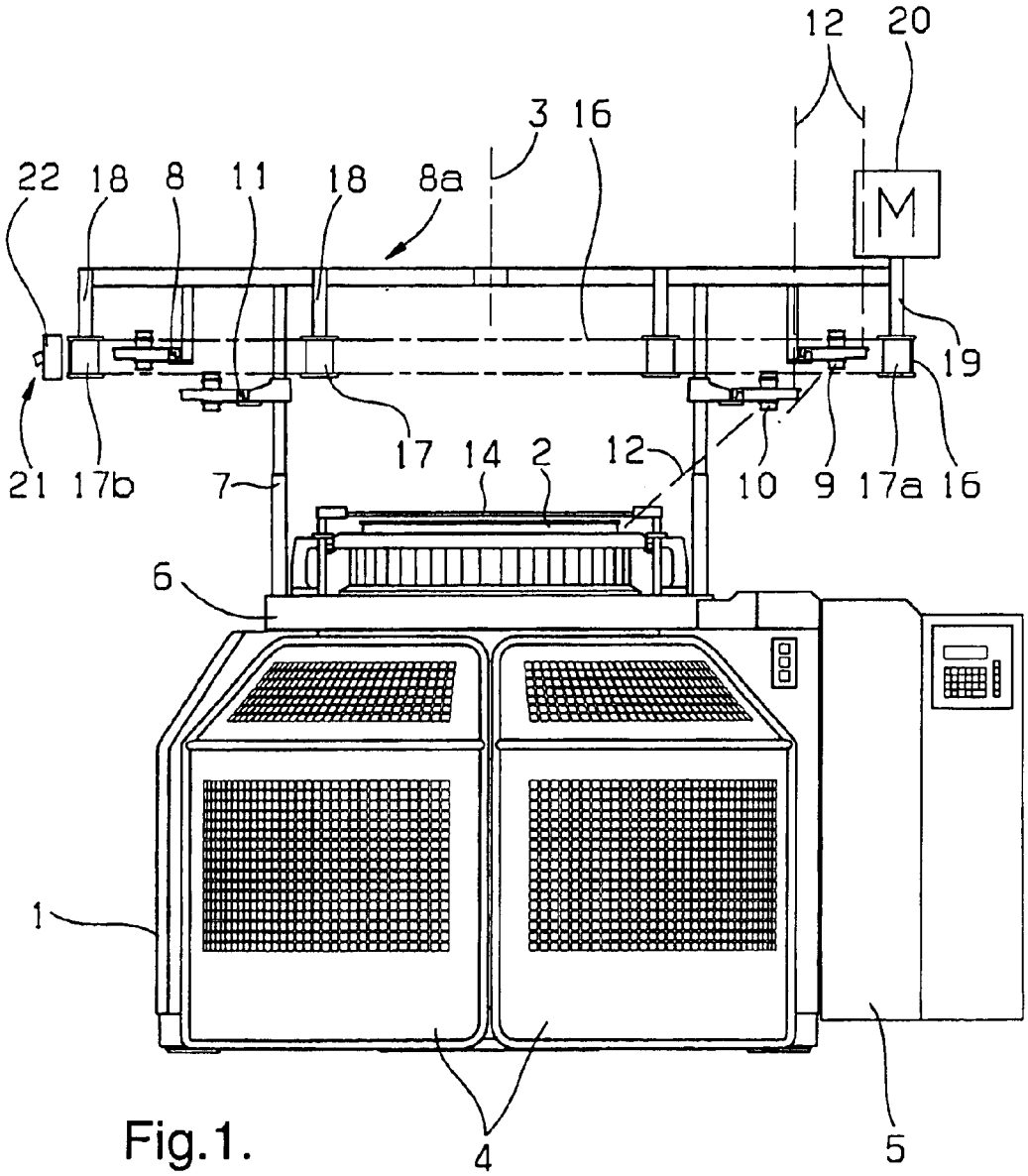
FIG. 1 is a highly schematic view of a circular knitting machine with a dust removal device according to the invention.
Figure 2:
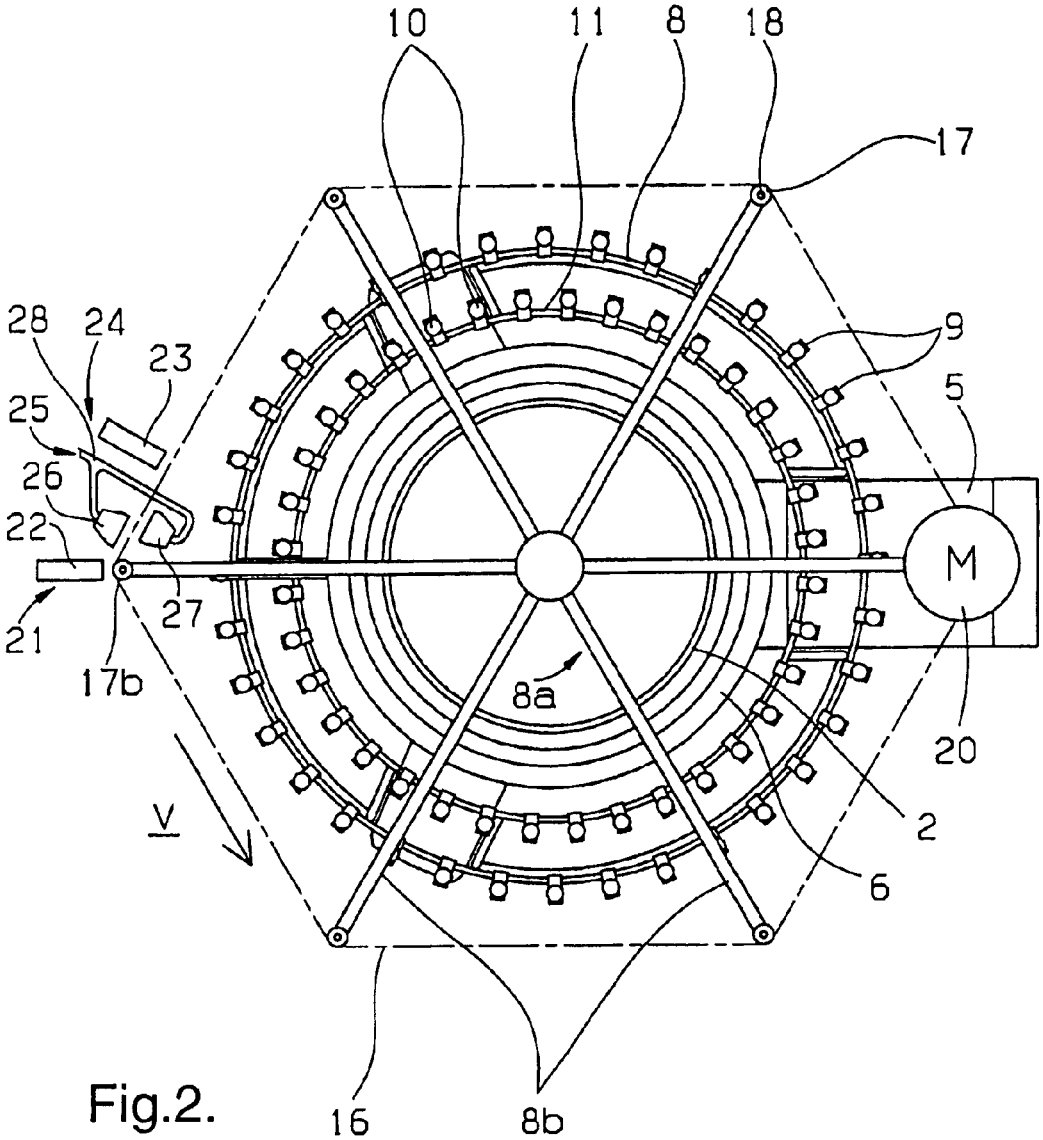
FIG. 2 is a top view onto the circular knitting machine according to FIG. 1.

According to FIGS. 1 and 2, a conventional circular knitting machine, only shown very roughly, has a frame 1, in which a needle cylinder 2 is disposed to rotate around a rotational axis 3. Knitting tools (not shown) are disposed in the needle cylinder 2 to move up and down, and are controlled in a known manner by the needle cams of a cam box ring surrounding the needle cylinder 2. A take-down and winding-up device for the knitting textile produced by the knitting tools is arranged below the needle cylinder 2 and is surrounded by a protective grate provided with doors 4. A control box 5, in which in particular the predominantly electrical control and drive units necessary for operating the circular knitting machine are housed, is provided on a laterally disposed part of the frame 1.

Several vertical supports 7 are supported on a base plate 6 of the frame 1 and carry a cross-type support 8*a*, which is disposed above the circular knitting machine and consists essentially of a plurality of radially extended support arms 8*b* connected to one another in the centre by a disc. A support ring 8, only indicated in section in FIG. 1, which is disposed coaxially to the rotational axis 3 is suspended on the cross-type support 8*a* in a manner not shown in more detail and has thread feed devices 9 fastened to it. The thread feed devices 9 preferably lie in a plane disposed perpendicular to the rotational axis 3. In the embodiment, further thread feed devices 10 are disposed in at least a second plane, likewise perpendicular to the rotational axis 3, and fastened, for example, to a second support ring 11 mounted on the supports 7 and also only indicated in section in FIG. 1, which is likewise disposed coaxially to the rotational axis 3. The thread feed devices 9, 10 serve to feed threads 12 shown in broken lines in FIG. 1 to the knitting tools at knitting points or knitting systems of the circular knitting machine not shown in more detail, wherein these threads 12 are unwound from usual storage bobbins, which can be disposed on a further support ring of the circular knitting machine or also on a bobbin creel arranged next to the circular knitting machine. The precise feed of the threads 12 into the circular knitting machine is assured by means of thread guides, which are fastened on a thread guide ring 14 supported on the base plate 6 coaxially to the rotational axis 3.

Circular knitting machines of this type are generally known to the person skilled in the art (e.g. DE 79 26 865 U1, DE 36 28 851 A1) and do not therefore need to be explained in more detail.

According to the invention, the described circular knitting machine is equipped with a dust removal device. In the embodiment, deemed to be the best one up to now, this contains a dust collector element 16 in the form of a continuous belt made from high-resistance material, which is represented by dot-dash lines in FIG. 2. The collector element 16 abuts against external surface areas of a plurality of guide rollers 17, which are rotatably disposed on mountings 18 and can preferably rotate around axes parallel to the rotational axis 3. The guide rollers 17, like the thread feed devices 9, are distributed around the rotational axis 3 and expediently arranged in one plane, wherein the mountings 18 are fastened to the same cross-type support 8*a* as the support ring 8. Moreover, one of the guide rollers 17*a* is preferably configured as a drive roller. This drive roller 17*a* is fastened, for example, on the drive shaft 19 of an electric drive motor 20 or similar, as a result of which the collector element 16 can be set in a rotational or transport movement rotating around the rotational axis 3 in a selected direction of rotation, e.g. in FIG. 2 in an anti-clockwise direction (arrow v).

The dust collector element 16 is preferably assigned to the thread feed devices 9 such that it rotates on a path of movement, which lies approximately in the same plane, in which the thread feed devices 8 are arranged, wherein the path of movement in addition preferably runs close to the outsides of the thread feed devices 9.

As shown in particular in FIG. 2, a station 21 determined for electrostatic charging is assigned to the belt-type collector element 16, said station containing at least one charge electrode 22 (cf. also FIG. 3), by means of which the collector element 16 can be positively or negatively charged, depending on the case. Moreover, at a point located shortly before the station 21 in the direction of movement, a means for removing the dust is provided, which in the embodiment contains a station 24 (FIGS. 2 and 4), which is determined for discharge of the collector element 16 and has at least one discharge electrode 23, and a dust extractor device 25 (FIGS. 2 and 5), which is expediently disposed between the two electrodes 22 and 23 in the direction of movement of the collector element 16. As FIG. 2 shows, the extractor device 25 has two extractor or suction hoods 26, 27, for example, which are disposed on opposite broad sides of the collector belt 16 and face the belt 16 at their open sides, whereas the rear sides of the extractor hoods 26, 27 are connected via pipes 28 to a suction fan (not shown), which acts in the direction of the arrows shown in FIG. 5.

The collector element 16 is preferably made of a high-resistance material, e.g. polyvinyl chloride (PVC) or rubber. The high resistance property serves the purpose of holding an electrical charge applied to a specific section of the collector element 16 by means of the charge electrode 22 as far as possible on this section until it reaches the charge electrode 23 together with the electrical charge on it during its transport in the direction of the arrow v. This means that the collector element 16 does not have to be re-charged between the two electrodes 22, 23 in order to compensate charges lost by self-discharge or similar.

The described circular knitting machine essentially works as follows:

During operation of the circular knitting machine, electrodes 22, 23 and station 24 are switched on, and the collector element 16 is caused to rotate by means of the drive motor 20 in the direction of the arrow v (FIG. 2) on a path of movement, which is predetermined by the position of the guide and/or drive rollers 17, 17*a*. At the same time, the collector element 16 is charged positively or negatively by means of the charge electrode 22 so that on continuing, electrically charged sections of the collector element 16 located continuously one behind the other are moved in the direction of the discharge electrode 23 and on the way there, electrically attract all the dust particles with opposite polarity located in the region of the collector element 16. The attracted dust particles then remain adhered to the collector element 16 until the corresponding belt sections reach the discharge station 24. The collector element 16 is discharged or electrically neutralised in this station by means of the discharge electrode 23 so that the electrical attraction force is removed and the entrained dust particles now only adhere comparatively loosely to the collector element 16. The individual belt sections are then fed to the extractor device 25 arranged behind the discharge station 24 in the transport direction, where it passes into the active region of the extractor hoods 26, 27 and thus has the dust particles located on it removed from both broad sides before they run into the charge station 21 again and the described cycle starts once again. In this case, the path measured in the direction of arrow v from the discharge electrode 23 to the charge electrode 22 is as short as possible, so that only a small section of the circumference of the collector element 16 is consistently not available for the collection and transport of dust.

If a material with inadequately high resistance is used for the collector element 16, several discharge stations 21 may, of course, also be provided along its path of movement.

For charging the belt-type collector element 16, it can be provided that a guide roller 17*b* (FIG. 2) located directly opposite the charge electrode 22 is made from such a material as plexiglass, for example, so that it acts as an exciter roller. This should be understood to mean that the guide roller 17*b* and the collector element 16 are in this case have opposing charges as a result of contact electricity, i.e. are already charged because of their close contact (or friction) and subsequent separation. In this case, the charge electrode 22 can be configured as a point electrode, which is charged by the guide roller 17*b* by the influence of opposed polarity, and additionally charges the belt-type collector element 16 running past it by point or corona discharge accordingly. The collector element 16 can then, as described above, electrically attract all dust particles charged opposite to it on its way to the discharge electrode 23. Alternatively, however, the guide roller 17*b* could also be made of an electrically conductive material and act as counter-electrode to the charge electrode.

The described dust removal device has the substantial advantage that only one common dust attracting belt is necessary for a plurality of feed devices 9 and the removal of dust can be performed at a single central point, i.e. here on site of the extractor device 25. Moreover, it is clear that for the case where the thread feed devices 9 and 10 (FIG. 1) are arranged in several planes, a separate dust removal device, which, in a similar manner to FIGS. 1 to 5, has a respective charge or discharge electrode 22, 23 and an extractor device 25, could be assigned to each individual plane thereof.

If the described dust removal device is used in a flat knitting machine instead of a circular knitting machine, then it would be possible, for example, to have the belt-type collector element 16 rotate on an elongated essentially straight path with two parallel strands instead of a circuit. In this case, it would, moreover, be possible to perform the charging of the collector element 16 at one return point and the discharging of the collector element 16 at another return point of the carriage of the flat knitting machine and arrange the collector element at a level at which the heaviest dust development would be expected.

Instead of a moving belt, other collector elements could also be provided, in particular such in the form of chargeable collector plates or similar, on which charged dust particles or dust particles polarised in an electric field are deposited. Such plates could, moreover, be provided at individual function points of the textile machine, in particular at an individual thread feed device. In this case, the dust can be removed by electrically neutralising the collector plates from time to time in order to allow the dust particles to drop off possibly due to gravity, or to remove them in another way.

Figure 3:
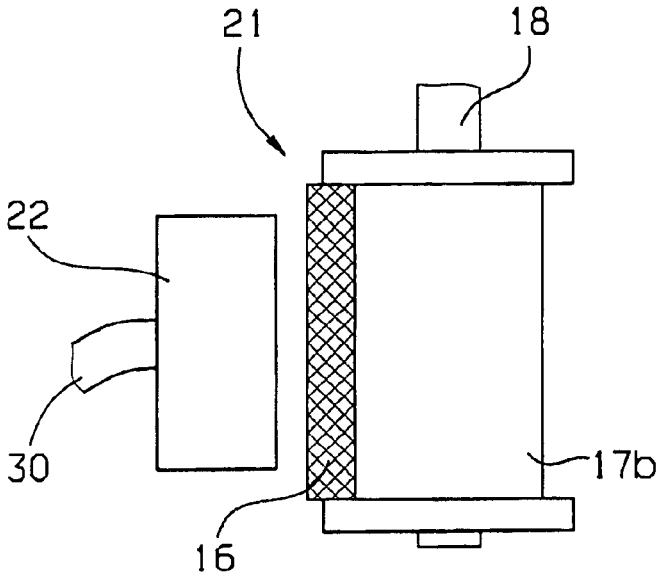
FIGS. 3 and 4 each show a charge and discharge electrode for a dust collector element of the circular knitting machine according to the invention on a larger scale than in FIGS. 1 and 2.
Figure 4:
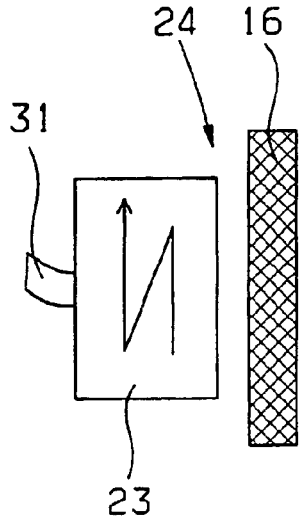
Figure 5:
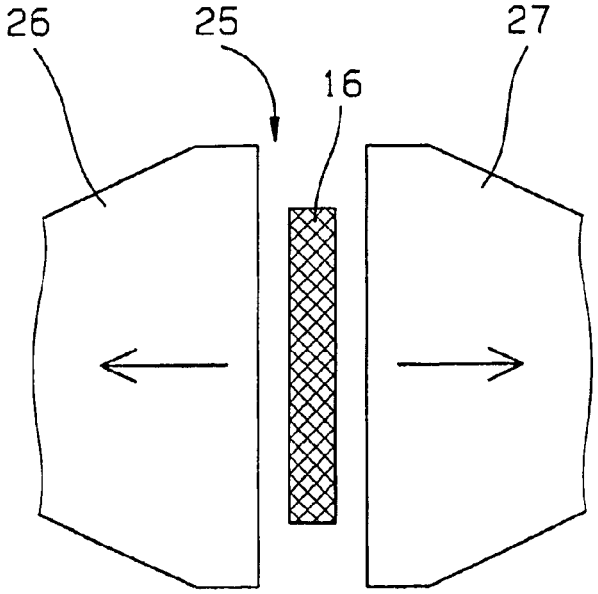
FIG. 5 is a schematic view of a means of the circular knitting machine according to the invention for removal of dust collected with the dust collector element shown on a larger scale than in FIGS. 1 and 2.

Otherwise, electrodes and devices allocated to these can be provided for charging and discharging the collector elements, as is generally known in association with stripping dusts from textile webs or similar (cf. the documents specified above). In this case, the magnitude of the high voltages to be possibly applied to the electrodes should be selected according to the individual case, in particular to the dust development in the individual case. The electric leads necessary for this are indicated in FIGS. 3 and 4 with the references 30 and 31.

The invention is not restricted to the described embodiment, which could be modified a plurality of ways. For example, for the case where dusts of different polarities are to be removed, it would also be possible to provide dust removal devices, which have collector elements with correspondingly different polarities and/or to provide the dusts with a selected polarity as a result of strong electric fields. In addition, the collector elements could be allocated to other devices than the thread feed devices described. In principle, it is possible to attach a device corresponding to one of the above-described dust and flint removing means to all thread deflection units and also in the region of the thread guide. In addition to the extractor device 25, at least one blower device could also be provided in order to accelerate or enhance the detachment of the dusts from an allocated collector element. Depending on the amount of dust, it is additionally possible to provide two or more discharge stations and extractor devices behind the charge station in the transport direction of the collector element 16 to thus improve the removal of the accumulated dust. Moreover, knitting machine types other than those evident from FIGS. 1 and 2 can be equipped with the dust removal devices according to the invention. It is clear in all cases here that the designation "belt" should include all cross-sections suitable for the described purpose, i.e. in particular rectangular, square or also round cross-sections. Finally, it must be understood that the different features can also be applied in combinations other than those illustrated and described.

It will be understood, that each of the elements described above or two or more together, may also find a useful application in other types of constructions differing from the types described above.

While the invention has been illustrated and described as embodied in a circular knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. Textile machine comprising at least one dust removal device, said dust removal device having at least one electrostatically chargeable dust collector element (16), means for charging said dust collector element (16), and means (24, 25) for removing dust collected with the dust collector element (16).

2. Textile machine according to claim 1 and being designed as a circular knitting machine.

3. Textile machine comprising at least one dust removal device containing at least one electrostatically chargeable dust collector element (16) and a means (24, 25) for removing dust collected with the dust collector element (16), wherein said collector element (16) contains a moveable belt made from high-resistance material, said belt being arranged for the transport of dust to a central dust removal point.

4. Textile machine according to claim 3, wherein a station (21) determined for electrostatic charging is associated with said collector element (16) and wherein said means for removing the dust has a station (24) determined for discharging said collector element (16) and a dust removal device (25).

5. Textile machine according to claim 2, and further comprising a plurality of thread feed devices (9) distributed around a rotational axis (3), wherein said collector element (16) is assigned to said thread feed devices (9).

6. Textile machine according to one of claim 3, wherein a plurality of guide rollers (17) and at least one drive roller (17*a*) are provided for said collector element (16).

7. Textile machine according to one of claim 3, wherein a plurality of guide rollers (17) and at least one drive roller (17*a*) are provided for said collector element (16) and at least one guide roller (17*b*) is provided at said station (21) determined for charging, said at least one guide roller (17*b*) being made from a conductive material.

8. Textile machine according to claim 3, wherein a plurality of guide rollers (17) and at least one drive roller (17*a*) are provided for said collector element (16) and wherein at least one guide roller (17*b*) is provided at said station (21) determined for charging, said at least one guide roller (17*b*) being made from a conductive material whereas other rollers of said plurality of guide rollers (17) are made of a non-conductive material.

9. Textile machine according to claim 8, wherein said at least one guide roller (17*b*) is configured as an exciter roller.

10. Textile machine comprising at least one dust removal device containing at least one electrostatically chargeable dust collector element (16) and a means (24, 25) for removing dust collected with the dust collector element (16), wherein said collector element (16) contains a moveable belt made from high-resistance material, said belt being arranged for the transport of dust to a central dust removal point.

11. Textile machine comprising at least one dust removal device containing at least one electrostatically chargeable dust collector element (16) and a means (24, 25) for removing dust collected with the dust collector element (16), wherein said dust collector element (16) has at least one continuous belt rotating around a rotational axis (3) of said circular knitting machine.

12. Textile machine comprising at least one dust removal device containing at least one electrostatically chargeable dust collector element (16) and a means (24, 25) for removing dust collected with the dust collector element (16), wherein the textile machine being designed as a circular knitting machine, and a plurality of thread feed devices (9, 10), which are distributed around a rotational axis (3) and arranged in at least two planes lying one above the other, and wherein said dust removal device for each plane has at least one continuous, circulating collector element (16) and a means (24, 25) associated with said element (16) for the removal of dust.

* * * * *